US008882311B2

(12) United States Patent
Snell

(10) Patent No.: US 8,882,311 B2
(45) Date of Patent: Nov. 11, 2014

(54) LENS ASSEMBLY FOR LIGHTING FIXTURE

(75) Inventor: Nathan R. Snell, Raleigh, NC (US)

(73) Assignee: Cree, Inc., Durham, NC (US)

( * ) Notice: Subject to any disclaimer, the term of this patent is extended or adjusted under 35 U.S.C. 154(b) by 92 days.

(21) Appl. No.: 13/458,466

(22) Filed: Apr. 27, 2012

(65) Prior Publication Data

US 2013/0286646 A1 Oct. 31, 2013

(51) Int. Cl.
*F21V 17/00* (2006.01)
*F21V 21/03* (2006.01)

(52) U.S. Cl.
USPC ..... 362/374; 362/147; 362/375

(58) Field of Classification Search
USPC ..... 362/147, 364, 365, 366, 374, 375, 453, 362/455
See application file for complete search history.

(56) References Cited

U.S. PATENT DOCUMENTS

| | | | | |
|---|---|---|---|---|
| 5,180,219 | A | 1/1993 | Geddie | |
| 6,382,818 | B1 * | 5/2002 | Iwama et al. | 362/374 |
| 7,147,341 | B2 * | 12/2006 | Nowak et al. | 362/375 |
| 7,213,940 | B1 | 5/2007 | Van De Ven et al. | |
| 8,096,670 | B2 * | 1/2012 | Trott et al. | 362/147 |
| 2010/0195330 | A1 | 8/2010 | Schaefer et al. | |
| 2010/0254129 | A1 | 10/2010 | Le Toquin et al. | |
| 2010/0259919 | A1 * | 10/2010 | Khazi et al. | 362/246 |
| 2011/0110095 | A1 | 5/2011 | Li et al. | |
| 2012/0287625 | A1 * | 11/2012 | Macwan et al. | 362/366 |

FOREIGN PATENT DOCUMENTS

WO 2008036873 A2 3/2008

OTHER PUBLICATIONS

International Search Report and Written Opinion for PCT/US2013/038155, mailed Jul. 4, 2013, 10 pages.

* cited by examiner

*Primary Examiner* — Y My Quach Lee
(74) *Attorney, Agent, or Firm* — Withrow & Terranova, P.L.L.C.

(57) ABSTRACT

The present disclosure relates to a lighting fixture. In one embodiment, the lighting fixture includes a reflector and a lens. The reflector includes a first flange that defines a forward opening and includes at least one tab receiver outside of the forward opening. The lens has an outer periphery and includes at least one tab that is configured to mate with the tab receiver of the first flange, such that when each tab is mated with a corresponding tab receiver, the lens is affixed to the reflector. In this arrangement, there are no dark spots visible on the lens due to the presence of the tabs when light is emanating from the lighting fixture.

19 Claims, 5 Drawing Sheets

SECTION A-A

SECTION A-A

LENS ASSEMBLY FOR LIGHTING FIXTURE

FIELD OF THE DISCLOSURE

The present disclosure relates to lighting fixtures, and in particular, to a lens assembly for a lighting fixture.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications. Many of these lighting fixtures employ an array of LEDs, which emit light that is directed through a lens.

SUMMARY

The present disclosure relates to a lighting fixture. In one embodiment, the lighting fixture includes a reflector and a lens. The reflector has a first flange that defines a forward opening and includes at least one tab receiver outside of the forward opening. The lens has an outer periphery and includes at least one tab that is configured to mate with the tab receiver of the first flange, such that when each tab is mated with a corresponding tab receiver, the lens is affixed to the reflector. In this arrangement, there are no dark spots visible on the lens due to the presence of the tabs when light is emanating from the lighting fixture.

In this embodiment, the lighting fixture may also include a housing and an array of LEDs. The housing has an interior in which the reflector is mounted. The array of LEDs may be arranged near a rearward opening of the reflector such that light emanating from the array of LEDs is directed forward through the lens.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
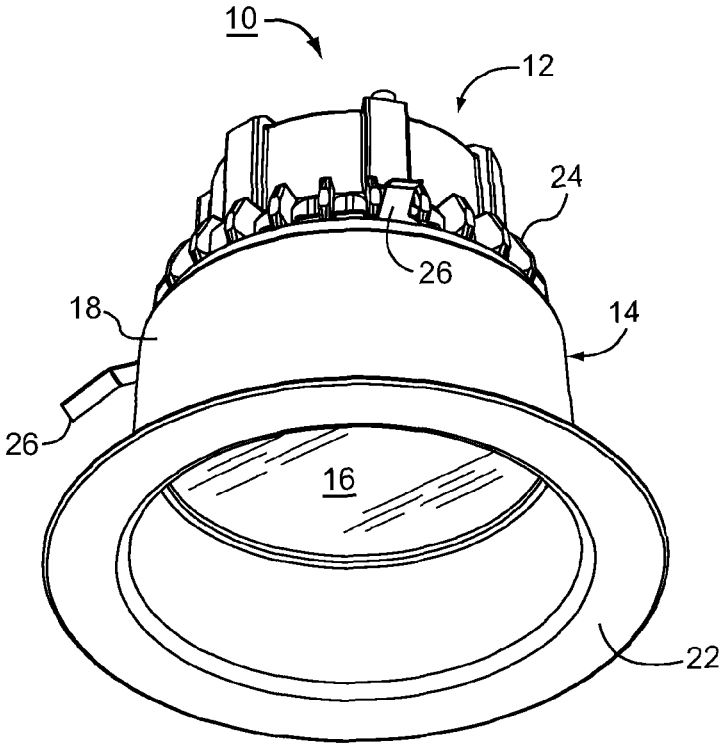
FIG. 1 is an isometric view of the front of the lighting fixture according to one embodiment of the disclosure.
Figure 2:
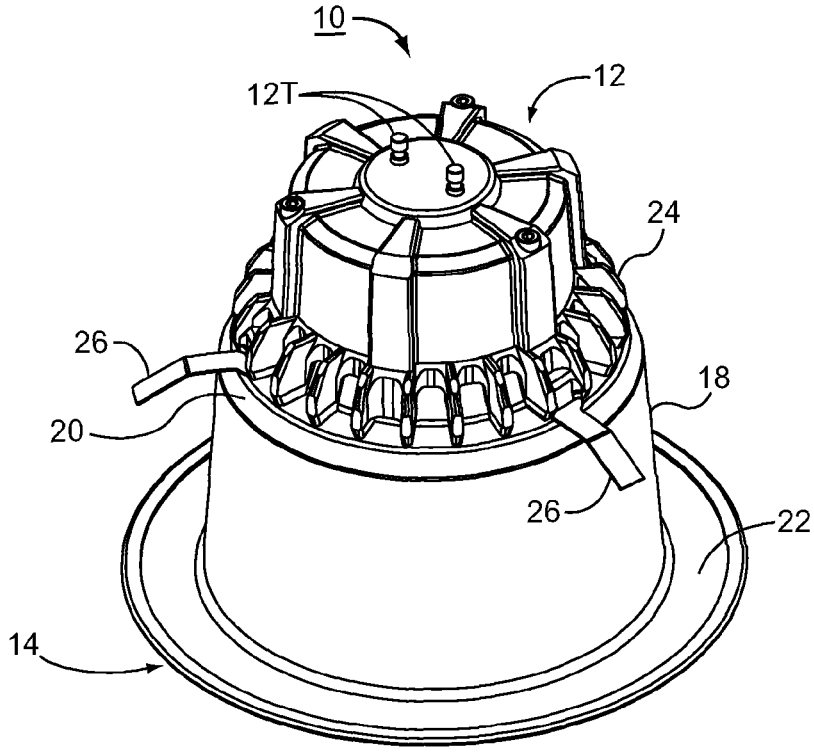
FIG. 2 is an isometric view of the back of the lighting fixture of FIG. 1.

The present disclosure relates to a lens assembly for a solid-state lighting (SSL) fixture. With reference to FIGS. 1 and 2, a lighting fixture 10 is illustrated according to one embodiment of the present disclosure. While the lighting fixture 10 in this embodiment is illustrated for reference, those skilled in the art will recognize that virtually any type of solid-state lighting fixture may benefit from the subject lens assembly and the concepts embodied therein.

As shown, the lighting fixture 10 includes a control module 12, a housing 14, and a lens 16. A light source (not shown), which will be described in further detail below, is mounted inside the housing 14 and oriented such that light is emitted from the housing through the lens 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, those skilled in the art will recognize that the concepts disclosed herein are applicable to virtually any size and lighting application.

The lens 16 may include one or more lenses that are made of clear or transparent materials, such as polycarbonate or acrylic glass or any other suitable material. As discussed further below, the lens 16 may be associated with a diffuser for diffusing the light emanating from the light source and exiting the housing 14 via the lens 16. Further, the lens 16 may also be configured to shape or direct the light exiting the housing 14 via the lens 16 in a desired manner.

The control module 12 and the housing 14 may be integrated and provided by a single structure. Alternatively, the control module 12 and the housing 14 may be modular wherein different sizes, shapes, and types of control modules 12 may be attached or otherwise connected to the housing 14 and used to drive the light source provided therein.

In the illustrated embodiment, the housing 14 is cup-shaped and includes a sidewall 18 that extends between a bottom panel 20 at the rear of the housing 14, and a rim, which may be provided by an annular flange 22 at the front of the housing 14. A heat sink 24 may be provided on the bottom panel 20 and between the control module 12 and the housing 14. The heat sink 24 has a central body and fins extending radially from the central body. Further, one or more mounting clips 26 may be mounted to the housing 14 or heat sink 24 and extend radially outward from a central axis of the lighting fixture 10. In the illustrated embodiment, the mounting clips 26 are designed to affix the lighting fixture inside a cylindrical recessed lighting housing (not shown) for new or remodel construction. The mounting clips 26 effectively press against the inside surface of the walls of the recessed lighting housing, and via a friction fit, hold the lighting fixture inside the recessed lighting housing.

Once the lighting fixture is in place, the face of the annular flange 22 may form part of a decorative trim ring assembly that rests flush against a surface, such as a drywall ceiling, into which the lighting fixture 10 is recessed. The exposed portion of the inside surface of the sidewall 18 of the housing 14 may also form part of the decorative trim ring assembly that extends into the ceiling. As such, when the lighting fixture 10 is mounted in a ceiling, the primary portions of the lighting fixture 10 that are typically visible are the face of the annular flange 22, the exposed portion of the sidewall 18, and the lens 16, which is roughly sized to the diameter of the housing 14 at the mounting location. Detail on the lens 16 and how the lens 16 is mounted within the lighting fixture 10 is provided further below.

Figure 3:
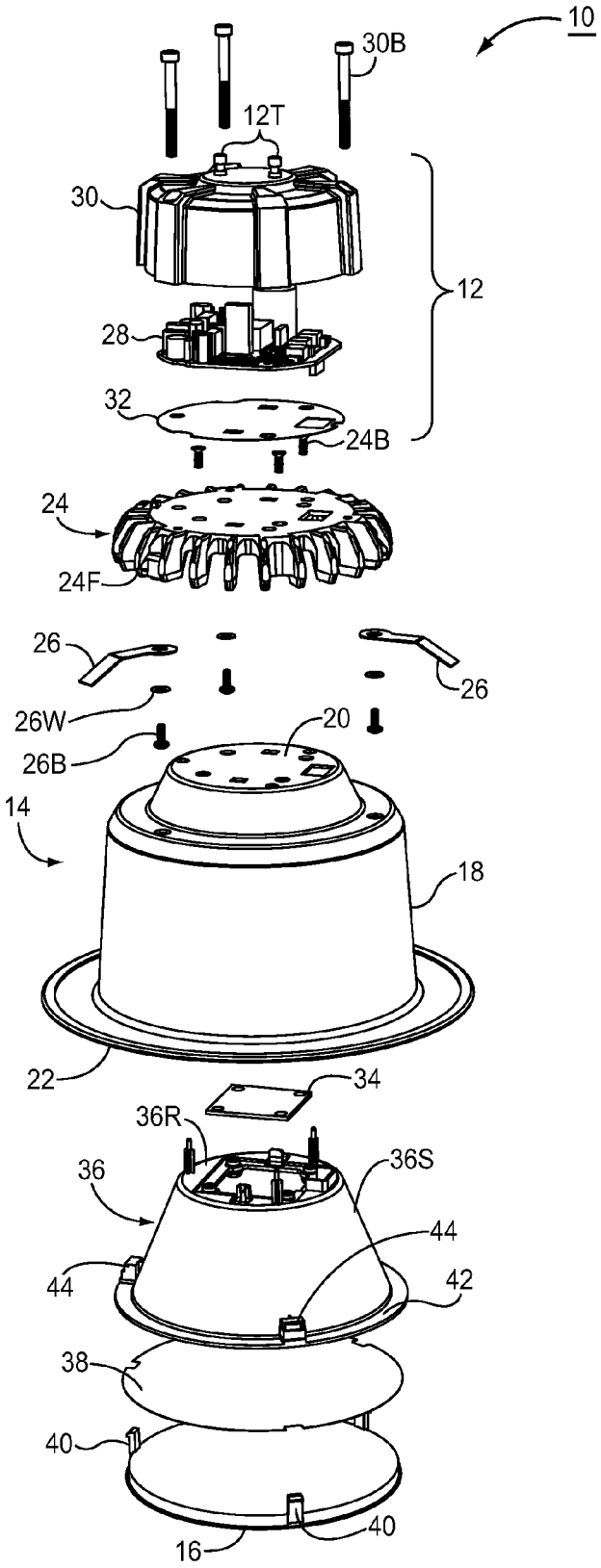
FIG. 3 is an exploded isometric view of the lighting fixture of FIG. 1.

With reference to FIG. 3, an exploded view of the lighting fixture 10 of FIGS. 1 and 2 is provided. The control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30 and provided an electrical barrier. Once the control module cover 32 is in place, the control module electronics 28 are contained within the control module housing 30 and the control module cover 32. The control module 12 is, in the illustrated embodiment, mounted to the rear surface of the heat sink 24. Bolts 26B and washers 26W are used to attach the mounting clips 26 to the body of the heat sink 24, wherein the mounting clips 26 reside between two adjacent fins of the heat sink 24.

The control module electronics 28 may be used to provide all or a portion of power and control signals necessary to power and control the light source 34, which may be mounted on the front surface of the bottom panel 20 of the housing 14 as shown, or in an aperture (not shown) provided in the bottom panel 20. Aligned holes or openings in the bottom panel 20 of the housing 14 allow the heat sink 24 to be bolted to the housing using bolts 24B. The control module housing 30, control module electronics 28, and control module cover 32 may be bolted to the heat sink 24 using bolts 30B. Openings in the control module cover 32, the heat sink 24, and the bottom panel 20 of the housing 14 are provided to facilitate an electrical connection between the control module electronics 28 and the light source 34.

As illustrated, GU24-type terminals 12T though which power is provided to the control module electronics 28 are provided on the rear of the control module housing 30. In an alternative embodiment (not shown), the control module 12 may provide a traditional Edison-type threaded base that is configured to screw into a conventional light socket wherein the lighting fixture resembles or is at least a compatible replacement for a conventional incandescent light bulb.

In the illustrated embodiment, the light source 34 is solid-state and employs one or more light emitting diodes (LEDs) and associated electronics (not shown), which are mounted to a printed circuit board (PCB) to generate light at a desired intensity and color temperature. The LEDs are mounted on the front side of the PCB, while the rear side of the PCB is mounted to the front surface of the bottom panel 20 of the housing 14 directly or via a thermally conductive pad (not shown). In this embodiment, the thermally conductive pad has a low thermal resistivity, and therefore, efficiently transfers heat that is generated by the light source 34 to the bottom panel 20 of the housing 14 and further on to the heat sink 24 for dissipation.

In the illustrated embodiment, the light source 34 is mounted in a smaller opening in the rear 36R of a reflector cone 36. The reflector cone 36 resides within an interior chamber provided by the housing 14. In the illustrated embodiment, the reflector cone 36 has a conical sidewall 36S that extends between an annular flange 42 that has a larger front opening and the rear 36R that has the smaller opening. The outside diameter of the annular flange 42 substantially corresponds to the inside dimension of the sidewall 18 of the housing 14 at a resting location. The smaller rear opening of the reflector cone 36 resides about and substantially corresponds to the size of the LED or array of LEDs provided by the light source 34. The inside surface of the sidewall 36S of the reflector cone 36 is generally, but not necessarily, highly reflective in an effort to increase the overall efficiency and optical performance of the lighting fixture 10. In certain embodiments, the reflector cone 36 is formed from metal, paper, a polymer, or a combination thereof. Any of these materials may have reflective coatings applied thereto. While not limited thereto, the reflector 36 may be affixed to the bottom panel 20 of the housing 14 or other portion of the housing 14 with bolts that extend thought the rear panel and thread into the heat sink 24.

When assembled, the lens 16 may be mounted on or over the annular flange 42 of the reflector 36. One or more diffusers 38 may be provided between the annular flange 42 and the lens 16. In the illustrated embodiment, the lens 16 and the diffuser 38 are generally circular and correspond in shape and size of the outer periphery of the annular flange 42. In other embodiments, rectangular, polygonal, elliptical and the like flanges, lenses 16, and diffusers 38 may be employed. When the lens 16 and diffuser 38 are circular, the housing 14 may be substantially cylindrical and the reflector 36 may be substantially conical, as depicted; however, these elements may take on various shapes. Continuing with FIG. 3, the lens 16 may include tabs 40, which extend rearward from the outer periphery of the lens 16. The tabs 40 may slide into corresponding tab receivers 44, which are provided on the annular flange 42 of the reflector 36.

The degree and type of diffusion provided by the diffuser 38 may vary from one embodiment to another. Further, color, translucency, or opaqueness of the diffuser 38 may vary from one embodiment to another. Separate diffusers 38, such as that illustrated in FIG. 3, are typically formed from a polymer, glass, or thermoplastic, but other materials are viable and will be appreciated by those skilled in the art. Similarly, the lens 16 is planar and generally corresponds to the shape and size of the diffuser 38 as well as the inside diameter of the housing 14 at a point where the lens 16 and diffuser are to be mounted. As with the diffuser 38, the material, color, translucency, or opaqueness of the lens 16 may vary from one embodiment to another. Further, both the diffuser 38 and the lens 16 may be formed from one or more materials or one or more layers of the same or different materials. While only one diffuser 38 and one lens 16 are depicted, the lighting fixture 10 may have multiple diffusers 38 or lenses 16. In other embodiments, the lens 16 and diffuser 38 may be integrated into a single uniform structure. In the latter case, the structure is considered a lens with diffusing properties.

Figure 4:
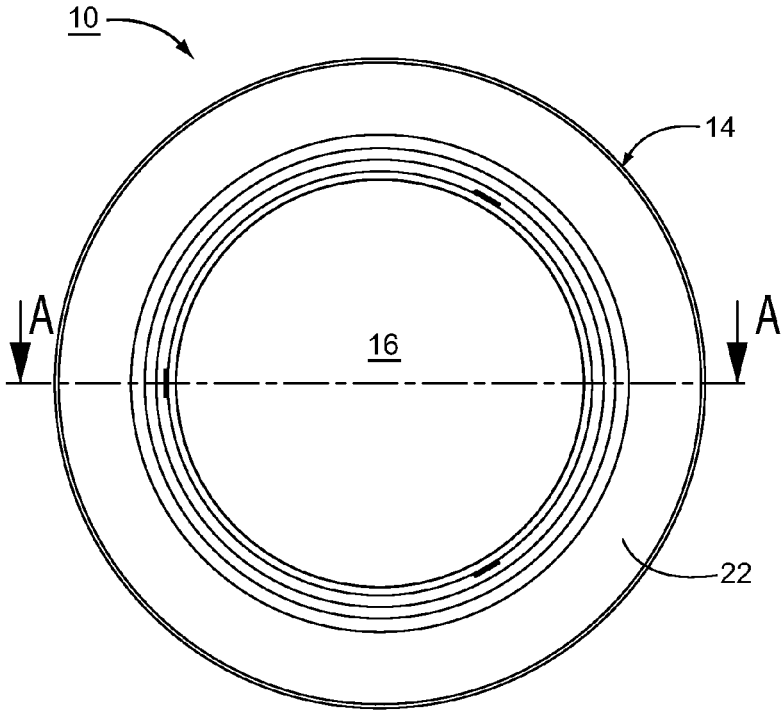
FIG. 4 is a front view of the front of the lighting fixture of FIG. 1 with a lens.
Figure 5:
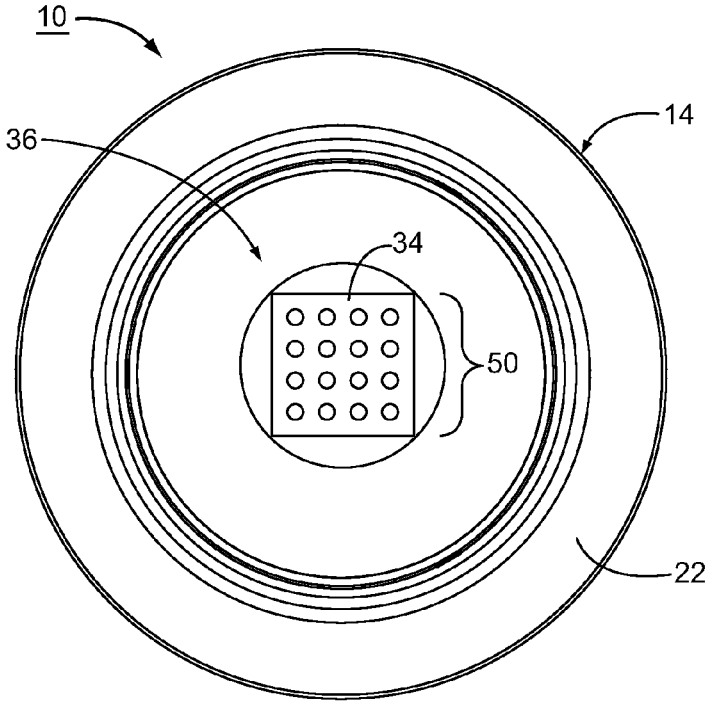
FIG. 5 is an isometric view of the front of the lighting fixture of FIG. 1 without the lens.

As noted above, the light source 34 provides an array of LEDs 50, as illustrated in FIG. 5. FIG. 4 provides a front view of the lighting fixture 10 with the lens 16 in place. FIG. 5 provides a front view of the lighting fixture 10 with the lens 16 and diffuser 38 removed, such that the conical reflector 36 and the light source 34 with an array of LEDs 50 are visible. The volume inside the reflector cone 36 and bounded by the rear opening 36R of the reflector cone 36 and the lens 16 or diffuser 38 is referred to as a mixing chamber.

Light emitted from the array of LEDs 50 is mixed inside the mixing chamber and directed out through the lens 16 in a forward direction to form a light beam. The array of LEDs 50 of the light source 34 may include LEDs 50 that emit different colors of light. For example, the array of LEDs 50 may include both red LEDs that emit red light and blue-shifted yellow (BSY) or blue-shifted green (BSG) LEDs that emit bluish-yellow or bluish-green light, respectively, wherein the red and bluish-yellow or bluish-green light is mixed to form "white" light at a desired color temperature. For additional information, reference is made to co-assigned U.S. Pat. No. 7,213,940, which is incorporated herein by reference in its entirety. For a uniformly colored light beam, relatively thorough mixing of the light emitted from the array of LEDs 50 is desired. Both the reflector cone 36 and the diffusion provided by the diffuser 38 play a role in mixing the light emanated from the array of LEDs 50 of the light source 34.

In particular, certain light rays, which are referred to as non-reflected light rays, emanate from the array of LEDs 50 and exit the mixing chamber through the diffuser 38 and lens 16 without being reflected off of the interior surface of the reflector cone 36. Other light rays, which are referred to as reflected light rays, emanate from the array of LEDs of the light source 34 and are reflected off of the front surface of the reflector cone 36 one or more times before exiting the mixing chamber through the diffuser 38 and lens 16. With these reflections, the reflected light rays are effectively mixed with each other and at least some of the non-reflected light rays within the mixing chamber before exiting the mixing chamber through the diffuser 38 and the lens 16.

The diffuser 38 functions to diffuse, and as result mix, the non-reflected and reflected light rays as they exit the mixing chamber, wherein the mixing chamber and the diffuser 38 provide the desired mixing of the light emanated from the array of LEDs 50 of the light source 34 to provide a light beam of a consistent color. In addition to mixing light rays, the lens 16 and diffuser 38 may be designed and the reflector cone 36 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight. From an aesthetics perspective, the diffusion provided by the diffuser 38 also prevents the emitted light from looking pixelated and obstructs the ability for a user to see the individual LEDs of the array of LEDs 50.

Figure 6:
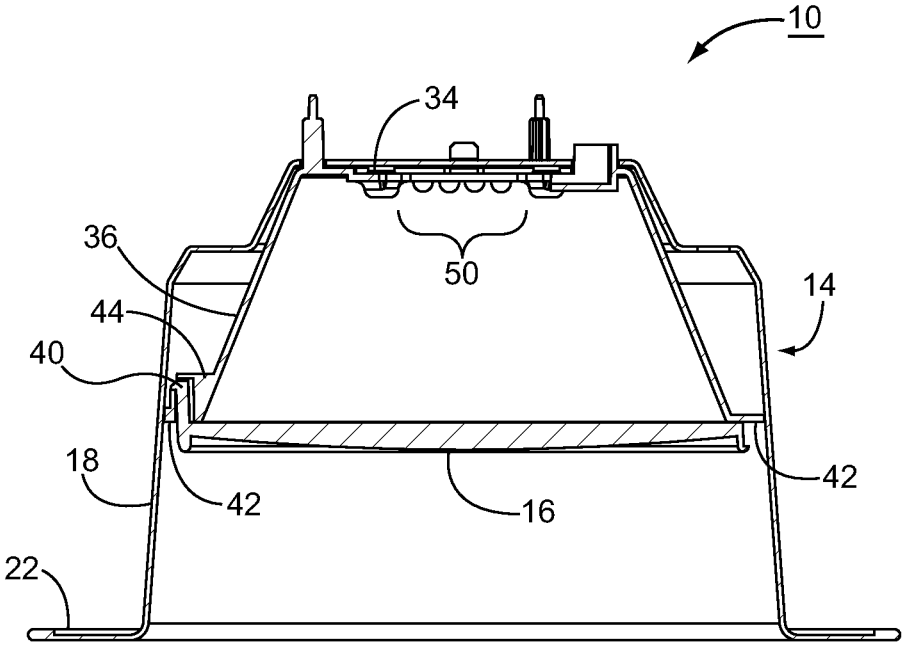
FIG. 6 is a cross sectional view of the lighting fixture of FIG. 1.

FIG. 6 illustrates a cross-section along line A-A of the lighting fixture 10 illustrated in FIG. 4. The heat sink 24, control module 12, and mounting clips 26 are not illustrated, as the focus of the remaining discussion is on the unique way in which the lens 16 is attached to the lighting fixture 10. As illustrated, the lens 16 has projecting tabs 40, which project from the annular flange 42. The tabs 40 are configured to slide into the tab receivers 44, which reside in the annular flange 42 of the reflector 36, and lock into place once the lens 16 reaches its proper mounting position. As such, the tabs 40 are formed to include or are otherwise equipped with a male locking mechanism, and the tab receivers 44 provide a complementary female locking mechanism, wherein the male and female locking mechanisms mate with one another such that the male locking mechanism locks into the female locking mechanism upon being fully inserted into the female locking mechanism.

Figure 7:
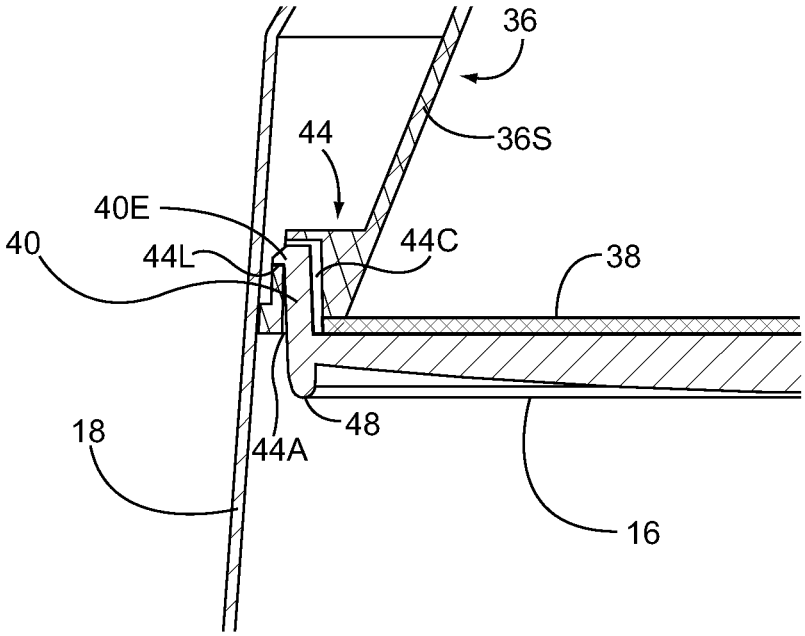
FIG. 7 is an enlarged section of a cross sectional view of the lighting fixture of FIG. 1.

An exemplary locking mechanism is highlighted in FIG. 7, which provides an enlarged view of a tab 40 inserted into a tab receiver 44 once the lens 16 is in place. The reflector 36 may be sized relative to the housing 14 such that the lens 16 resides at least 25% or more into the housing 14 relative to the overall depth of the interior of the housing 14. Notably, the diffuser 38 is illustrated in FIG. 7, but not in FIG. 6 for clarity. As depicted, the distal end of the tab 40 has lateral projection, which forms an ear 40E. The tab receiver 44 has an aperture 44A that provides an opening to a channel 44C. At a distal end of the channel 44C, the tab receiver 44 includes a ledge 44L that may be associated with an opening or enlarged chamber.

The tab 40 is configured to spring laterally inward upon entering the tab receiver 44 due to the size or shape of the ear 40E. Once the ear 40E of the tab 40 extends past a certain point in a channel 44C of the tab receiver 44, the ear 40E will pass over the ledge 44L of the tab receiver 44. At this point, the tab 40 will spring laterally outward, such that the ear 40E catches on the ledge 44L to lock the lens 16 in place on the annular flange 42 of the reflector 36. Those skilled in the art will recognize other possible configurations for the respective locking mechanisms of the tab 40 and the tab receiver 44.

A unique benefit of the disclosed structure is that the presence of the tabs is not noticeable, or at worst minimally visible, during operation of the lighting fixture. In prior configurations, tabs on the lens 16 were inside the outer opening of the reflector 36. In such a configuration, the presence of the tabs being within or directly adjacent to the mixing chamber resulted in relatively darkened regions appearing around the periphery of the lens 16 where the tabs 40 are located when the lighting fixture 10 was emanating light. By laterally moving the tabs 40 outside of the outer opening of the reflector 36 as disclosed above, minimal or no darkened regions appear on the lens 16 when the lighting fixture 10 is emanating light.

Further, the lens 16 may be formed with a peripheral ridge 48, and the lens 16 may have a convex (shown), concave (not shown), or other surface contouring, as illustrated in FIG. 7, to further control dispersion of emanated light. The peripheral ridge 48 may be substantially aligned with the tabs 40. The tabs 40 may be separately or integrally formed with the rest of the structure of the lens 16. Similarly, the tab receivers 44 may be separately or integrally formed with the rest of the structure of the reflector 36.

Those skilled in the art will recognize improvements and modifications to the embodiments of the present disclosure. All such improvements and modifications are considered within the scope of the concepts disclosed herein.

What is claimed is:

1. A lighting fixture comprising:

a reflector comprising a first flange that defines a forward opening and includes at least one tab receiver outside of the forward opening and extending towards a rear of the reflector; and a lens having an outer periphery and comprising at least one tab and a peripheral ridge on a forward face of the lens where the at least one tab is aligned with the peripheral ridge, the at least one tab being configured to mate with the at least one tab receiver of the first flange, wherein when the at least one tab is mated with the at least one tab receiver, the lens is affixed to the reflector.

2. The lighting fixture of claim 1 wherein the at least one tab extends rearward toward the reflector and comprises a distal end with an ear and the at least one tab receiver provides a channel configured to receive the at least one tab.

3. The lighting fixture of claim 2 wherein the channel extends between an aperture in a forward face of the first flange and an opening that provides a ledge on which the ear locks once the at least one tab is inserted into the channel a defined distance.

4. The lighting fixture of claim 3 wherein the at least one tab is sprung laterally inward as the ear travels through the channel and moves laterally outward once the ear clears the ledge upon the at least one tab being inserted into the channel the defined distance.

5. The lighting fixture of claim 1 wherein the at least one tab receiver is a female locking mechanism, the at least one tab is a male locking mechanism, and the female locking mechanism and the male locking mechanism are configured to mate with one another.

6. The lighting fixture of claim 1 further comprising a housing having an interior in which the reflector is mounted.

7. The lighting fixture of claim 6 wherein the housing includes a second flange that provides a part of a decorative trim ring for the lighting fixture.

8. The lighting fixture of claim 7 wherein when the lens is affixed to the reflector, the lens is at least twenty-five percent (25%) recessed into the interior of the housing.

9. The lighting fixture of claim 6 further comprising a diffuser that resides between the lens and the first flange.

10. The lighting fixture of claim 6 wherein the reflector is conical, the housing is substantially cylindrical, and the lens is substantially circular.

11. The lighting fixture of claim 6 further comprising an array of LEDs arranged near a rearward opening that is opposite the forward opening and arranged such that light emanating from the array of LEDs is directed forward through the lens.

12. The lighting fixture of claim 11 wherein there are no dark spots visible on the lens due to the presence of the at least one tab when light is emanating from the array of LEDs.

13. The lighting fixture of claim 11 wherein there are essentially no dark spots visible on the lens due to the presence of the at least one tab when light is emanating from the array of LEDs.

14. The lighting fixture of claim 11 wherein the array of LEDs comprises at least one LED that emits reddish light and at least one LED that emits either a bluish yellow light or a bluish green light.

15. The lighting fixture of claim 11 further comprising a control module for powering the array of LEDs.

16. The lighting fixture of claim 1 wherein the lens is at least one of polycarbonate or acrylic glass.

17. The lighting fixture of claim 1 wherein the lighting fixture is a recessed lighting fixture.

18. The lighting fixture of claim 1 wherein the at least one tab comprises a plurality of tabs and the at least one tab receiver comprises a like plurality of tab receivers.

19. A lighting fixture comprising:

a reflector comprising a first flange that defines a forward opening and includes at least one tab receiver outside of the forward opening and extending towards a rear of the reflector;

a lens having an outer periphery and comprising at least one tab and a peripheral ridge on a forward face of the lens where the at least one tab is aligned with the peripheral ridge, the at least one tab being configured to mate with the at least one tab receiver of the first flange, wherein when the at least one tab is mated with the at least one tab receiver, the lens is affixed to the reflector;

a housing having an interior in which the reflector is mounted;

an array of LEDs arranged near a rearward opening that is opposite the forward opening and arranged such that light emanating from the array of LEDs is directed forward through the lens, wherein there are no dark spots visible on the lens due to the presence of the at least one tab when light is emanating from the array of LEDs.

* * * * *